US009620011B2

(12) United States Patent
Cunningham

(10) Patent No.: US 9,620,011 B2
(45) Date of Patent: Apr. 11, 2017

(54) TRAFFIC SIGNALS AND RELATED METHODS

(76) Inventor: Thomas W. Cunningham, Orlando, FL (US)

( * ) Notice: Subject to any disclaimer, the term of this patent is extended or adjusted under 35 U.S.C. 154(b) by 927 days.

(21) Appl. No.: 13/311,093

(22) Filed: Dec. 5, 2011

(65) Prior Publication Data

US 2012/0140075 A1 Jun. 7, 2012

Related U.S. Application Data

(60) Provisional application No. 61/420,117, filed on Dec. 6, 2010.

(51) Int. Cl.
*G08G 1/095* (2006.01)
*G08G 1/096* (2006.01)

(52) U.S. Cl.
CPC ..... *G08G 1/095* (2013.01); *G08G 1/096* (2013.01)

(58) Field of Classification Search
CPC ..... G08G 1/095; G08G 1/096
USPC ..... 348/148; 340/907, 929, 906
See application file for complete search history.

(56) References Cited

U.S. PATENT DOCUMENTS 2,588,739 A 3/1952 Main
4,775,865 A * 10/1988 Smith et al. ..... 340/906
5,726,648 A 3/1998 Soon
6,087,962 A 7/2000 Rojas
6,268,805 B1 7/2001 Simon
6,552,668 B1 4/2003 Berezovsky
7,864,071 B2 1/2011 Bachelder et al.
2004/0008127 A1* 1/2004 Manavi et al. ..... 340/907
2010/0141477 A1* 6/2010 Lim et al. ..... 340/906
2012/0078506 A1* 3/2012 Husain ..... 701/414
2012/0274481 A1* 11/2012 Ginsberg et al. ..... 340/905

FOREIGN PATENT DOCUMENTS

KR 20-0299848 1/2003
KR 20-0340119 1/2004
KR 10-0482303 4/2005

OTHER PUBLICATIONS

International Searching Authority, PCT Notification of the International Search Report and Written Opinion of the International Searching Authority, entire report.

* cited by examiner

*Primary Examiner* — Behrooz Senfi
(74) *Attorney, Agent, or Firm* — Allen Dyer Doppelt Milbrath & Gilchrist

(57) ABSTRACT

Traffic signals include displays and controllers for displaying information relating to the general condition of the traffic signal. The information can include a time remaining in seconds until the next change in the general condition. Traffic signal systems are adaptable to facilitate passage of emergency vehicles through intersections, including traffic signal systems with flat panel screens. The displays can be flat panel screens displaying information in multiple information formats.

3 Claims, 5 Drawing Sheets

TRAFFIC SIGNALS AND RELATED METHODS

CROSS-REFERENCE TO RELATED APPLICATIONS

This application claims the benefit of U.S. Provisional Application Ser. No. 61/420,117, filed Dec. 6, 2010, the contents of which are herein incorporated by reference in their entirety.

FIELD OF THE INVENTION

The present invention relates to traffic signals for controlling the flow of vehicles and pedestrians and the use thereof.

BACKGROUND OF THE INVENTION

Traffic signals are widely used throughout the world to control the flow of vehicular and foot traffic on and across roadways. Most commonly, traffic signals include one or more lighted sections, whose shape, relative location and/or color conveys commands or prohibitions to motorists and/or pedestrians. Perhaps the most common example is the three colored traffic signal, featuring three distinct round lights, or round groups of lights, in red, yellow and green. When the lights are arranged vertically, the red light is usually on top with the yellow and green lights thereunder, in that order. When the lights are arranged horizontally, the red light is usually to the left, with the yellow and green lights to the right thereof, in that order. A very common pedestrian traffic signal features the words DON'T WALK or STOP and WALK or GO, or alternatively pictograms representing standing and walking people, in alternate sections.

While these conventional traffic signals have the advantage of being very widely recognized and understood, they convey relatively little information to the pedestrian or motorist. Some improvements have been advanced to allow additional information to be conveyed by traffic signals; for instance, the inclusion of a graphical or numerical countdown at pedestrian crosswalks. However, further improvements are still possible.

SUMMARY OF THE INVENTION

In view of the foregoing, it is an object of the present invention to provide improved traffic signals and related methods of use.

According to an embodiment of the present invention, a traffic signal system includes at least one flat panel screen, and at least one controller configured to operate the at least one flat panel screen to display at least first and second information sections. The controller is configured to display traffic signal information in different information formats in the first and second information sections.

According to another embodiment of the present invention, a traffic signal system includes a display device, and at least one controller configured to operate the display device to display at least a plurality of numbers indicating a time remaining in seconds until a next change in a general condition of a traffic signal.

According to a further embodiment of the present invention, a traffic signal system for an intersection includes a plurality of traffic signals directed to a plurality of lanes approaching the intersection from a plurality of directions, the plurality of lanes including a plurality of lanes approaching the intersection from the same direction, and at least one controller configured to operate the at least one flat panel screen to display the traffic signals. The controller is configured to change the general conditions of the traffic signals to facilitate passage of an emergency vehicle, and when the plurality of lanes approaching the intersection from the same direction are in a direction of emergency vehicle travel, to maintain or change the general condition of only a portion of such traffic signals to green to facilitate the passage of the emergency vehicle.

These and other objects, aspects and advantages of the present invention will be better appreciated in view of the drawings and following detailed description of preferred embodiments.

DETAILED DESCRIPTION OF PREFERRED EMBODIMENTS

Figure 1:
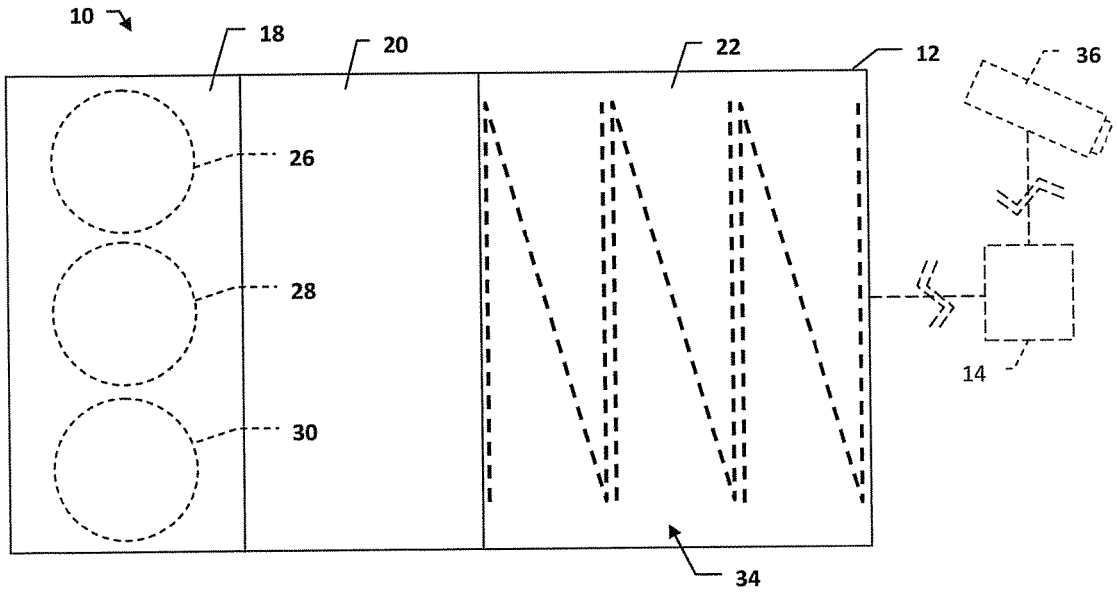
FIG. 1 is a schematic front view of a traffic signal including a flat panel screen, according to an embodiment of the present invention.

Referring to FIG. 1, according to an embodiment of the present invention, a traffic signal 10 includes at least one flat panel screen 12 in signal communication with a controller 14. The controller 14 is configured to operate the at least one flat panel screen 12 to display a plurality of information sections 18, 20, 22. The information sections 18, 20, 22 can include any type of visually depictable information for conveyance to motorists and/or pedestrians.

The present invention is not necessarily limited to any type of flat panel screen for the at least one flat panel screen 12. Non-limiting examples of flat panel screen types include liquid crystal (LCD) screens, light emitting diode (LED) screens, plasma screens and electroluminescent (ELD) screens. Where systems employ multiple flat panel screens, the present invention does not necessarily require that each screen be of the same type. Additionally, the present invention is not necessarily limited to any particular number, size, shape, contour or configuration of flat panel screens. Moreover, some aspects of the present invention are utilizable in connection with display devices that are not flat panel screens.

Where there are multiple lanes and multiple directions of travel meeting at an intersection, a single flat panel screen or a plurality of different screens can be used. Screens can be used for pedestrian and/or vehicle travel. Separate screens for the same intersection are advantageously synchronized, and multiple screens at different intersections can also be commonly coordinated; thus, multiple levels of traffic signal control, monitoring and coordination can be readily realized within a given geographical area. The screens can be attached to or suspended from poles, wires or other structures, as desired or required for a particular application.

To enhance visibility in adverse lighting conditions, the flat panel screen 12 can include a fixed or adjustable shade. Where an adjustable shade is employed, the controller 14 can be further configured to adjust the shade automatically depending on prevailing lighting conditions. Alternatively, or in addition to a shade, the controller 14 can be further configured to adjust the overall intensity of the flat panel screen based on prevailing lighting conditions.

The controller 14 includes at least one processor and machine readable memory adapted to allow the controller 14 to execute program instructions. The present invention is not necessarily limited to any number or type of processors, or to a particular type or format of memory, or to a particular programming language. Additionally, various functions of the controller 14 can be performed by separate, geographical dispersed processors communicating via a wired or wireless network or other communications medium. For example, some functions of the controller 14 can be executed by processors contained in the flat panel screen 12 while other functions could be executed by processors remote from the flat panel screen 12, such as within an enclosure adjacent to an intersection associated with the flat panel screen 12, or at a central traffic control location from which multiple flat panel screens 12 at multiple intersections are controlled.

The information section 18 is configured to display a virtual traffic light, with red, yellow and green circles 26, 28, 30 selectively displayed to control traffic flow. The use of the circles 26, 28, 30 allows viewers unfamiliar with the traffic signal 10 to readily recognize the general condition of the traffic signal. As used herein, the "general condition of the traffic signal" means what the traffic signal dictates regarding viewers whose movements would be controlled thereby. For example, display of the green circle 30 indicates that movement is permitted for the corresponding viewers.

The information section 20 is configured to display a large area of a solid color corresponding to the condition of the intersection. In addition to, or in lieu of, the solid color, the information section 20 could also be used to display other relevant information to corresponding viewers. As one example, the message "NO TURN ON RED" could be displayed, or the word name of the displayed color could be displayed (e.g., "GREEN").

The information section 22 displays a plurality of numbers 34. The numbers 34 are advantageously indicative of the time remaining until the next change in the general condition of the traffic signal 10 (e.g., green to yellow, yellow to red, red to green). Preferably, the numbers 34 indicate the time remaining until the next change in seconds, such that the actual time remaining is readily apparent to viewers who might not otherwise readily grasp the pace of a countdown in time intervals not corresponding to seconds. The numbers 34 preferably include four or fewer digits. Three digits will typically be sufficient, as capable of indicating times in seconds for countdowns to changes of over 16 minutes. This timing feature can be particularly advantageous for use with red light camera systems, to allow drivers the security and fairness of knowing exactly how long they have until a traffic signal will turn to red—thereby increasing the safety and acceptability of such systems. When used with such systems, the controller 14 can also be in signal communication with one or more cameras 36 for capturing images of vehicles that run red lights.

Timing schemes can be adopted that allow viewers waiting at a red light to know when opposing lights have turned red, such that cars should not be entering the intersection from other directions and the remaining wait until a green light is to ensure that the intersection is clear. This indication of time remaining after opposing lights have turned red but prior to the viewer's traffic signal turns green is referred to herein as a "pause count." The pause count can be indicated by displaying negative seconds (e.g., −5), remaining frozen at zero, or resetting to an appropriate number of positive seconds.

Timing schemes can also accommodate temporary override of the traffic signal to facilitate clearance of an intersection for passage of emergency vehicles. In response to a manual or automatic override associated with the approach an emergency vehicle, traffic signals associated with all travel directions other than that of the emergency vehicle can, if red, remain red, and if not red, the time remaining until a red light can be automatically decreased to (if not already within) a reduced time period, such as 30 seconds, with this change being reflected in the information section 22. Preferably, the reduced time period is short enough to result in red lights before the arrival of the emergency vehicle, but long enough to prevent the creation of a dangerous condition for vehicles previously approaching the intersection on a green light.

The traffic signal in the direction of emergency vehicle travel can be either changed or maintained, as applicable, in red or green. For instance, during lower traffic times and/or on lower traffic roadways, it may be preferable to have all lights at intersection red prior to emergency vehicle passage, while during higher traffic times and/or on higher traffic roadways, it may be preferably to have the traffic signal in the emergency vehicle direction be changed or maintained in a green condition, as applicable, to facilitate clearing the roadway and intersection ahead of the emergency vehicle. Where the general condition of the traffic signal must be changed, then advantageously the time remaining is reduced to (if not already within) the reduced time period—such as 30 seconds or less. Where there are multiple lanes of travel in the direction of emergency vehicle travel, advantageously only traffic signals for one or more of the lanes are changed or maintained in a green condition; for example, only rightmost or leftmost travel lanes. Advantageously, local traffic rules and conditions can be taken into consideration when determining which lane or lanes are selected; for instance, differing U.S. and British conventions about traffic direction.

While the traffic signal(s) at an intersection are operating in an emergency override mode, a message, such as "EMERGENCY" can be displayed on the flat panel screen 12; for instance, in the information area 20, or in a special information area created for this purpose. The traffic signal(s) are preferably maintained in the emergency override mode for a predetermined time period sufficient for the emergency vehicle to clear the intersection, such as approximately two minutes. This time can be indicated in the information section 34. Alternately, the duration of the emergency override mode can be maintained until it is determined, for instance by termination of an override signal, that the emergency vehicle has actually cleared the intersection.

Advantageously, various means can be used for determining when an emergency vehicle is approaching and clearing a given intersection. For instance, traffic signals at each intersection can be assigned discrete identifiers. The emergency vehicles can be equipped with radio or other transmitters that can communicate with the controller of the traffic signal(s) at the given intersection, and based upon reception of the correct identifier, can direct the controller to place the traffic signal into the emergency mode and subsequently release the traffic signal from emergency mode once clear. Alternately, the position of the emergency vehicle can be tracked (e.g., using a global positioning system (GPS) device or other position tracking system), with the position being transmitted to a central control system. The central control system has the ability to place any traffic signals within its area of control into the emergency mode, and can automatically do so, and subsequently direct the traffic signals to resume normal operation, based upon the transmitted positions of the emergency vehicle.

The height of the numbers 34 is preferably greater than the diameter of an individual light of a conventional traffic light to allow visibility from further away; for instance, greater than approximately 8 inches. Advantageously, the width of the numbers 34 can be greater than approximately 1½ inches. Alternately, smaller numbers can be used. Advantageously, each number 34 can be of a contrasting color with its background and/or outline to further enhance visibility. For example, the numbers 34 could be black and their outline and/or background white, or vice versa.

In the embodiment of FIG. 1, the flat panel screen 12 display is divided into three information sections 18, 20, 22; however, this number and arrangement is not necessarily a limitation. Fewer or more information sections could be used, and arranged in other orders/configurations, and the number of information sections displayed by a given flat panel screen is not necessarily constant, and could be changed in the course of operations of the traffic signal 10. In general, the flat panel screen 12 and controller 14 can cooperate to display colors, designs, shapes, words and the like within the capabilities the flat panel screen 12 to convey the desired information to viewers, such as motorists and/or pedestrians. Displayed material can incorporate blinking, movement and the like to further enhance its prominence.

Advantageously, the controller 14 can be configured to use one or more information sections 18, 20, 22 of the flat panel screen 12 to display the speed of one or more vehicles approaching an intersection and/or the applicable speed limit. The controller 14 can derive the vehicle speed information from a speed radar, camera or other speed detection device in communication therewith. The controller 14 can be further configured to flash or otherwise highlight speed if in excess of posted limits or in excess of a speed that would permit safe deceleration based on the time remaining until the next red light. By displaying vehicle speed, drivers of approaching vehicles are able to keep attention focused outside of the vehicle as the need to look down to the speedometer to gage vehicle speed is eliminated. Additionally, following vehicles can better anticipate the likelihood that a vehicle approaching the intersection in advance thereof will engage in rapid deceleration in response to a change in the light. The controller can also work in connection with a camera, such as the camera 36, to capture images of speeding vehicles.

Figure 2:
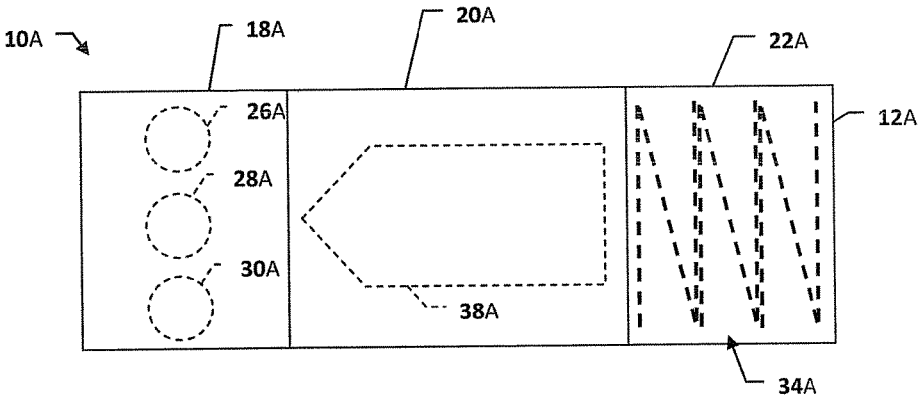
FIGS. 2 and 3 are schematic front views traffic signals including flat panel screens, according to further embodiments of the present invention.

Referring to FIG. 2, according to an another embodiment of the present invention, a traffic signal 10A has a flat panel screen 12A of different overall proportions, as well as different proportions for information sections 18A, 20A and 22A. Similar elements described in alternate embodiments herein are indicated with the same reference numerals, suffixed with a letter (e.g., 10A). The various alternate traffic signal 10 embodiments are all operable in signal communication with a controller, like the controller 14.

The information section 20A features a turn indication arrow 38A, that can be displayed, advantageously with a color corresponding to the general condition of the traffic signal 10A. The traffic signal 10A is well suited for use in a turn lane, and in the depicted embodiment, a left turn lane. It will be appreciated that reversing the order of the information sections 18A, 20A, 22A and the direction of the arrow 38A would render the traffic signal 10A well suited for a right turn lane. Due to the flexible nature of the flat screen display 12A, the only change required is in the instructions received from the controller and special right and left turn signals would not have to be separately ordered.

Figure 3:
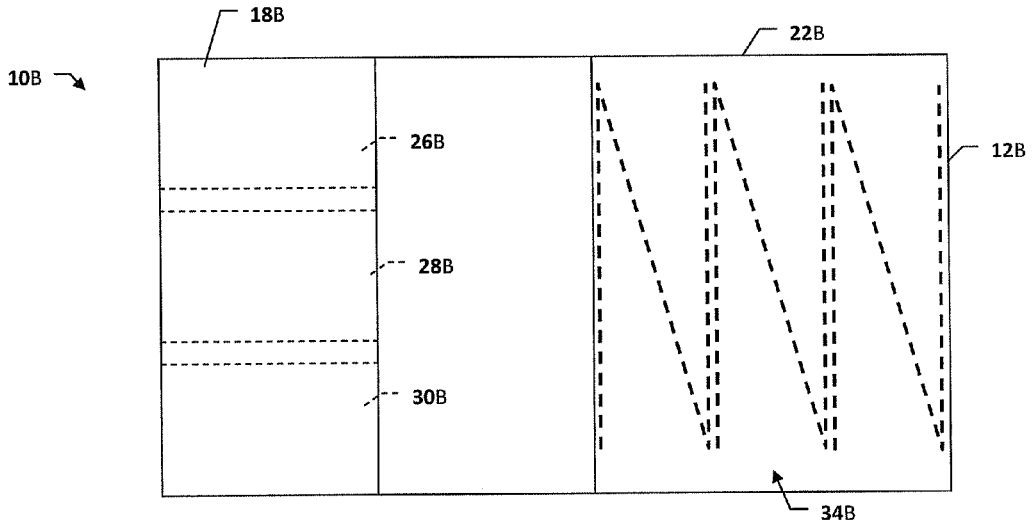
Figure 4:
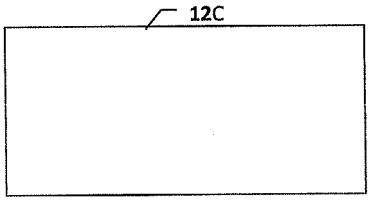
FIGS. 4-8 are front views of flat panel screens in alternate shapes, according to additional embodiments of the present invention.
Figure 5:
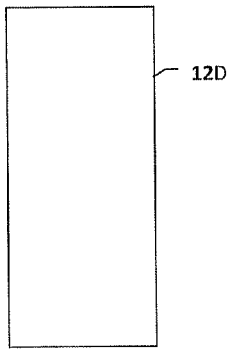
Figure 6:
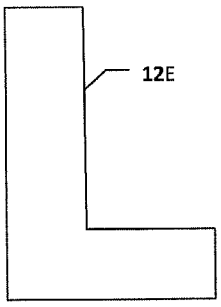
Figure 7:
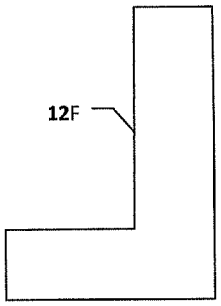
Figure 8:
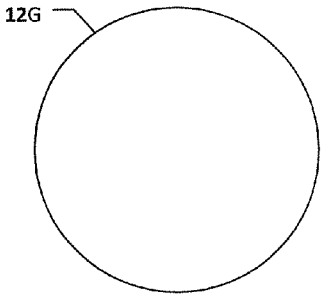
Figure 9:
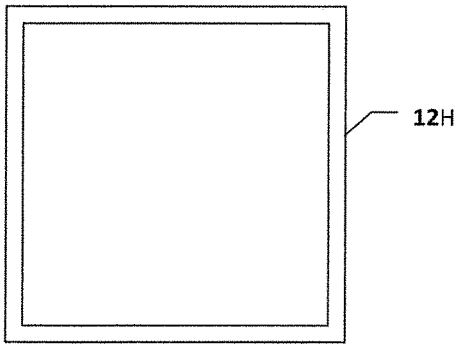
FIGS. 9-12 are top views of flat panel screens in alternate shapes, according to further embodiments of the present invention.
Figure 10:
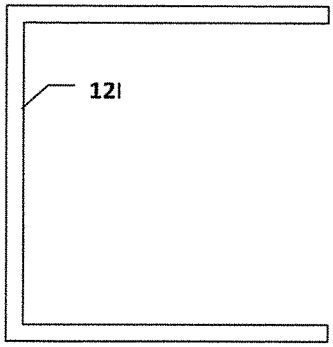
Figure 11:
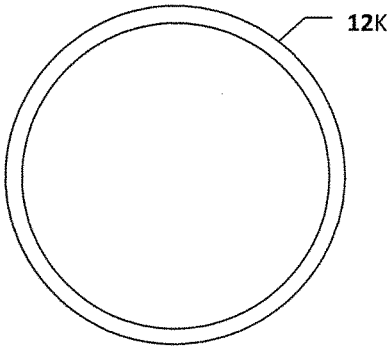
Figure 12:
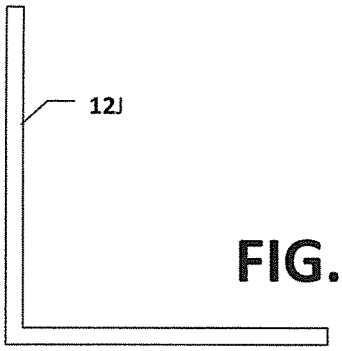

Referring to FIG. 3, according to a further embodiment of the present invention, a traffic signal 10B has a flat panel screen 12B with a first information section 18B configured to selectively display red, yellow and green rectangles 26B, 28B, 30B, in lieu of the circles 26, 28, 30 (see FIG. 1). The rectangles cover a large area, and therefore can potentially offer increased visibility. A traffic signal could be re-configured to shift from circles to rectangles after a population was determined to have been accustomed to the new traffic signal format.

Other shapes could also be used in the information section 18B, which could further correlate to the general condition of the traffic signal. For instance, the red area could have a stop sign shape, and the yellow area could have a caution sign shape. The green section could have an arrow shape or retain a circle shape.

Referring to FIGS. 4-8, possible alternate screen 12C-G shapes are shown from the front. The L-shapes of the displays 12E, 12F can advantageously allow placement around existing signage and/or traffic signals. The round shape of the display 12G can facilitate a clock-like graphical representation of time remaining in seconds.

Referring to FIG. 9-12, possible alternate screens 12H-K are shown from the top, illustrating how the flat panel screens can be shaped for signals controlling traffic from more than one direction; for example, four directions (screen 12H), three directions (12I) and two directions (12J). The circular screen 12K illustrates how the flexible properties of some flat panel screens can be taken advantages of in connection with the present invention. The screen 12K can be used to control traffic coming from more than four directions, if necessary.

Figure 13:
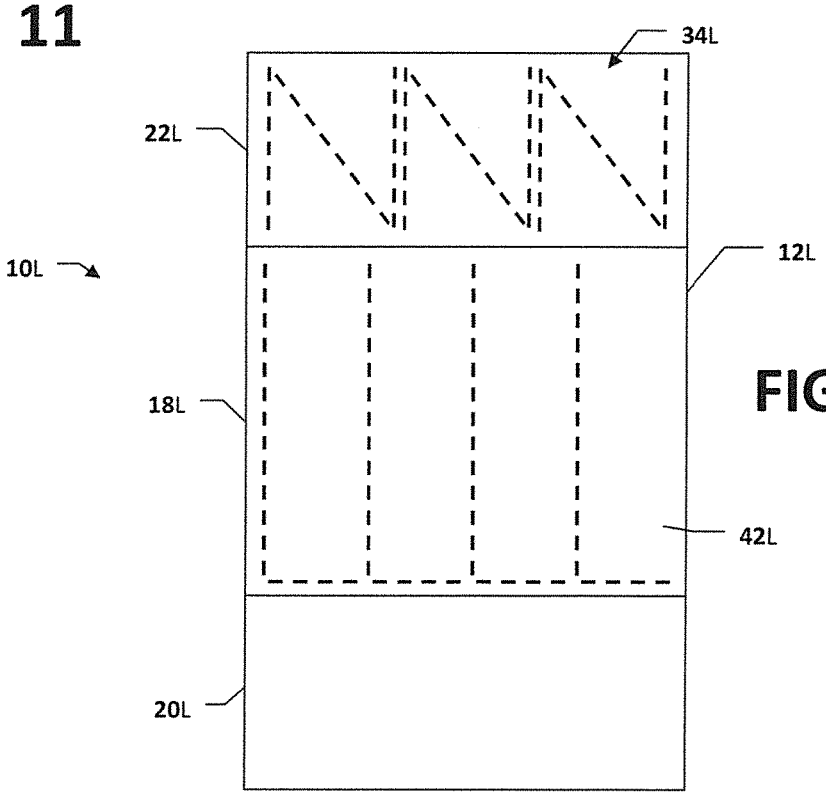
FIG. 13 is a schematic front view of a traffic signal including a flat panel screen, configured for controlling pedestrian traffic, according to another embodiment of the present invention.
Figure 14:
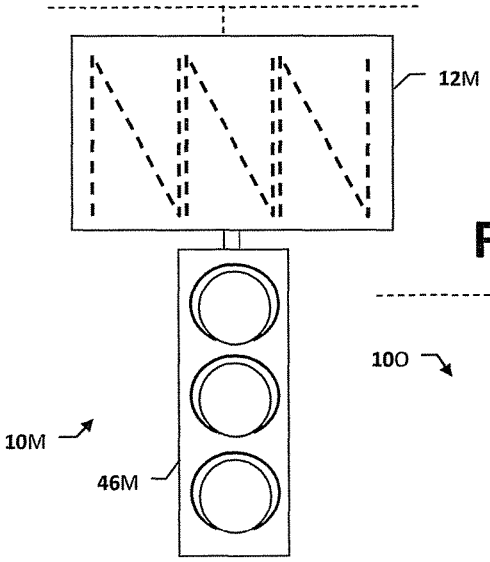
FIGS. 14-19 are traffic signals including flat panel screens with existing traffic lights, according to additional embodiments of the present invention.
Figure 16:
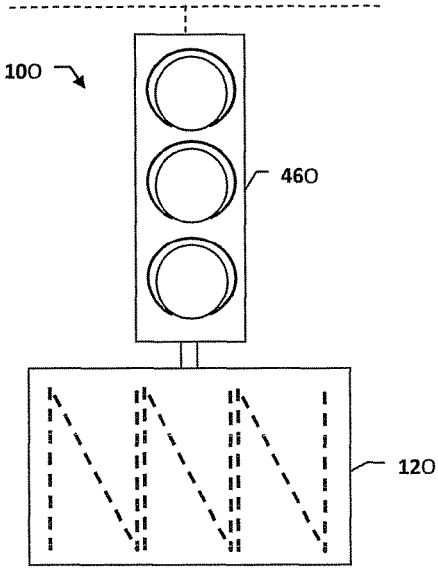
Figure 15:
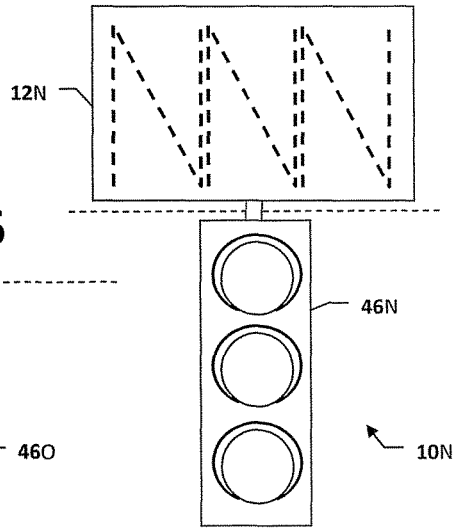
Figure 17:
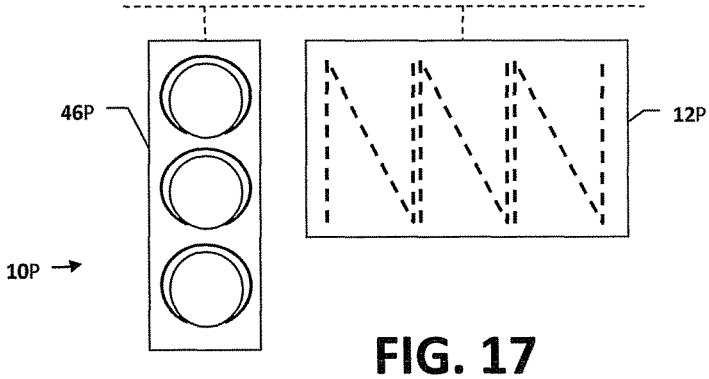
Figure 18:
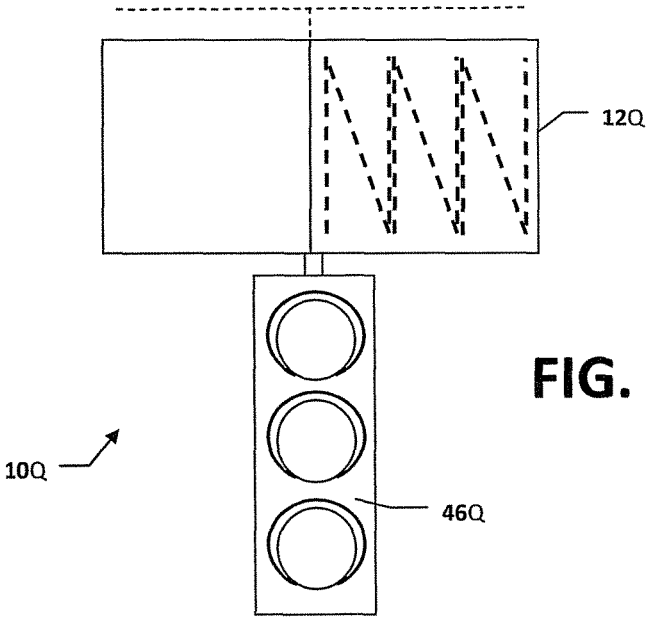
Figure 19:
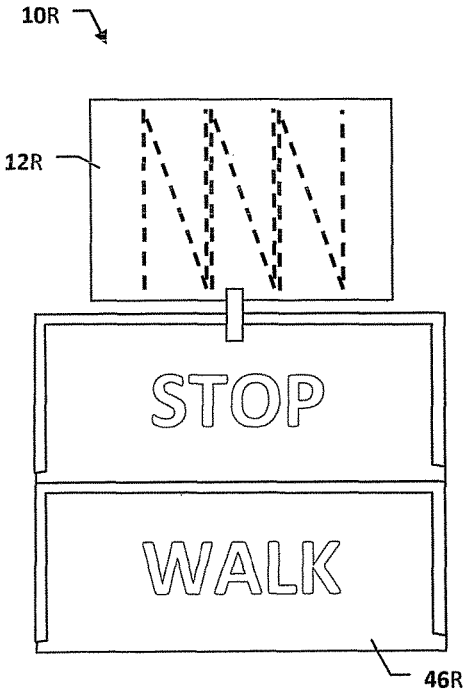
Figure 20:
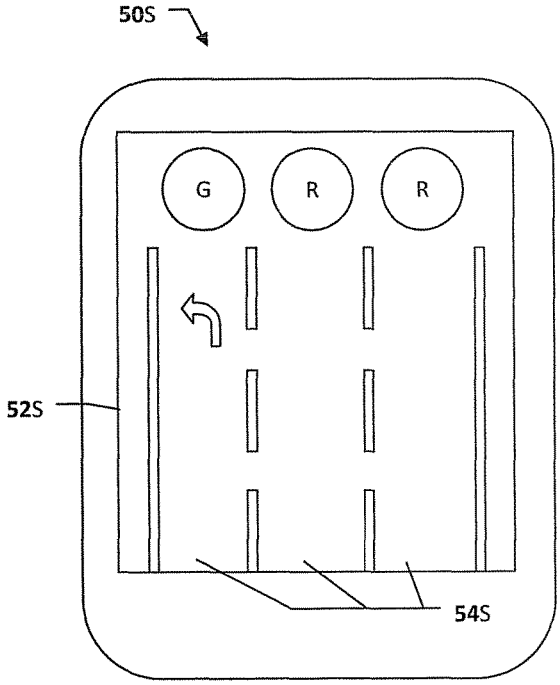
FIG. 20 is a schematic overview of a traffic signal manual control device, according to a further embodiment of the present invention.

Referring to FIG. 13, according to an additional embodiment of the present invention, a traffic signal 10L includes a flat panel screen 12L, configured with information sections 18L, 20L and 22L. The traffic signal 10L is advantageously adapted to control pedestrian traffic, with the information section 18L including a plurality of letters 42L that can selectively display texts like "STOP" and "WALK" to communicate the general condition of the traffic signal. An intermediate text or symbol, like an "X" can be used to indicate an intermediate state, if desired.

The information section 20L can be selectively used to display a solid color corresponding to the general condition, such as red, yellow and green, or just red and green, or just red and white, or other color combinations. Other information can also be displayed in this section, as desired. The information section 22L includes numbers 34L indicating the time in seconds until the next change in the general condition of the traffic signal, preferably in a manner similar to that discussed in connection with the traffic signal 10.

It will be appreciated that information sections need not have fixed boundaries or orders, but the number and configuration of information sections can be changed as desired during the operation of the traffic signal. Two information sections on a single flat panel screen or other display can be distinguished by the different information formats that are used to display information. Examples of information format types include textual, numerical, and graphical. Information formats can differ within these types; for instance, two information sections could display two different graphical formats—such as a stationary graphic and a moving graphic.

Referring to FIGS. 14-19, enhanced traffic signals 10M-R result from combining flat panel screens 12M-R with existing traffic lights 46M-R. The screens 12M-P and 12R are depicted with a signal information section; for example, depicting the seconds remaining until the next general condition change. However, it will be appreciated that the screens could be configured to display multiple information sections, as in the screen 12Q. It will further be appreciated that the screens could be used with various types of existing traffic signals, for example the pedestrian traffic signal 46R, three light signals 46M-P, as well two light signals or other types of signals.

Traffic signal systems according to the present invention can also include control and/or communications devices carried on vehicles approaching the traffic signals. For example, referring to FIG. 14, an emergency vehicle can be equipped with a control device 50S allowing a user to manually select which travel lanes in an upcoming intersection should be changed (or maintained) in a green condition to facilitate passage. The control device 50S can include a touch screen 52S or other input device(s) with a depiction of the travel lanes 54S for the upcoming intersection, each travel lane being individually selectable.

In general, the foregoing description is provided for exemplary and illustrative purposes; the present invention is not necessarily limited thereto. Rather, those skilled in the art will appreciate that additional modifications, as well as adaptations for particular circumstances, will fall within the scope of the invention as herein shown and described and of the claims appended hereto.

What is claimed is:

1. A traffic signal system for an intersection, the traffic signal system comprising:

a plurality of traffic signals directed to a plurality of lanes approaching the intersection from a plurality of directions, the plurality of lanes including a plurality of lanes approaching the intersection from the same direction; and at least one controller configured to operate the traffic signals;

wherein the controller is configured to change general conditions of the traffic signals to facilitate passage of an emergency vehicle, and when the plurality of lanes approaching the intersection from the same direction are in a direction of emergency vehicle travel, to maintain or change the general condition of only a portion of such traffic signals to green to facilitate the passage of the emergency vehicle; and wherein the controller is configured to communicate with a control device carried by the emergency vehicle, the control device allowing a user to specify which of the plurality of travel lanes in the direction of emergency vehicle travel are to have the traffic signals maintained or changed to green.

2. The traffic signal system of claim 1, further comprising at least one flat panel screen displaying at least one of the plurality of traffic signals.

3. The traffic signal system of claim 2, wherein the controller is configured to display a visual indication in one of the information sections of an emergency condition on the at least one flat panel screen while the general conditions of the traffic signals are being changed to facilitate passage of the emergency vehicle.

* * * * *